US006368403B1

(12) United States Patent
Schmid et al.

(10) Patent No.: US 6,368,403 B1
(45) **Date of Patent: *Apr. 9, 2002**

(54) METHOD AND APPARATUS FOR PURIFYING SILICON

(75) Inventors: Frederick Schmid, Marblehead; Chandra P. Khattak, Danvers; David B. Joyce, Marblehead, all of MA (US)

(73) Assignee: Crystal Systems, Inc., Salem, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/512,947

(22) Filed: Feb. 25, 2000

Related U.S. Application Data

(63) Continuation-in-part of application No. PCT/US98/17750, filed on Aug. 27, 1998, which is a continuation-in-part of application No. 08/919,898, filed on Aug. 28, 1997, now Pat. No. 5,972,107.

(51) Int. Cl.[7] ..... C30B 13/18
(52) U.S. Cl. ..... 117/79; 117/204; 423/328
(58) Field of Search ..... 117/79, 204; 423/348

(56) References Cited

U.S. PATENT DOCUMENTS

| | | | | |
|---|---|---|---|---|
| 4,456,480 A | | 6/1984 | Wintenberger | 75/63 |
| 4,684,513 A | | 8/1987 | Iya | 423/349 |
| 4,747,906 A | | 5/1988 | Shingu et al. | 156/624 |
| 4,818,495 A | | 4/1989 | Iya | 422/145 |
| 4,837,376 A | | 6/1989 | Schwirtlich et al. | 423/348 |
| 4,900,532 A | | 2/1990 | Kurz et al. | 423/348 |
| 5,182,091 A | * | 1/1993 | Yuge et al. | 423/348 |
| 5,208,001 A | | 5/1993 | Truitt et al. | 423/348 |
| 5,788,945 A | * | 8/1998 | Schei | 423/348 |
| 5,972,107 A | * | 10/1999 | Schmid et al. | 117/79 |

OTHER PUBLICATIONS

Khattak, C. P. et al, Production of Solar–Grade Silicon by Refining of Liquid Metallurgical–Grade Silicon,, Reprint of NREL NCPV AIP Con Proc. 462, pp. 731–736 (1998).

* cited by examiner

*Primary Examiner*—Felisa Hiteshew
(74) *Attorney, Agent, or Firm*—Hale and Dorr LLP

(57) ABSTRACT

An apparatus for purifying metallurgical grade silicon to produce solar grade silicon has a container for holding molten silicon and one or more torches for providing oxygen and hydrogen gas to heat the molten silicon so that the reaction time is prolonged, to create turbulence, and to introduce silica powder and water vapor for reactions with molten silicon. The molten silicon is then directionally solidified.

33 Claims, 1 Drawing Sheet

METHOD AND APPARATUS FOR PURIFYING SILICON

CROSS-REFERENCE TO RELATED APPLICATION

This application is a continuation-in-part of PCT/US98/17750, filed Aug. 27, 1998, which is a continuation-in-part of Ser. No. 08/919,898, filed Aug. 28, 1997, now U.S. Pat. No. 5,972,107. These documents are incorporated by reference for all purposes.

BACKGROUND OF THE INVENTION

The present invention relates to the purification of silicon.

Silicon that is used in the manufacture of solar cells must have a minimum purity that is referred to here as solar grade (SG) silicon. SG silicon has significantly higher purity than a lower metallurgical grade (MG) silicon, although solar grade can be lower than electronic grade (EG) silicon, which is used for manufacturing semiconductor devices. While MG silicon can have up to 10,000 ppm of impurities and EG silicon requires less than 1 ppb of donor or acceptor impurities, SG silicon should have no more than 5 ppm of metallic impurities.

To remove from a batch of silicon impurities that have low segregation coefficients, it is well known to provide directional solidification so that the impurities with low segregation coefficients can be segregated to the last part of the melt to solidify these impurities for removal. To remove impurities with high segregation coefficients, however, particularly boron and phosphorus, MG silicon is typically converted to a gaseous product and then purified by distillation.

A number of efforts have been made to efficiently produce SG silicon as an intermediate grade between MG silicon and EG silicon. In U.S. Pat. No. 5,182,091, for example, MG silicon is heated to a molten state in a refractory-lined crucible with a heating coil wrapped around it. A high-temperature, high-velocity plasma jet directs an inert gas with steam and/or silica powder from a height of 50 mm to produce a hot spot where boron and carbon escape. This approach requires the use of a plasma generator, which adds complexity and expense to a purification system.

In an article by Baba, et al, "Metallurgical Purification for Production of Solar Grade Silicon from Metallic Grade Silicon," a rather costly four-step process is described for refining small quantities of MG silicon. With this process, phosphorous is removed with an electron beam gun and the silicon melt is directionally solidified. Then, boron and carbon are removed by blowing argon plasma with water vapor into the melted silicon, and a second directional solidification process is performed. This process requires an hour to remove phosphorus and boron from just a few kilograms of liquid silicon, and also requires use of a plasma generator.

Other efforts have been made to produce SG silicon with methods that would provide lower cost than that required to produce EG than silicon. Such efforts have involved using higher purity raw materials in an arc furnace, acid leaching, reactive gas treatments in a molten state, slagging, and dissolution of MG silicon in a metal followed by recrystalization. None of these processes, however, has effectively removed a sufficient amount of impurities, particularly boron and phosphorous, in a cost-effective manner.

It would be desirable to have an efficient method for purifying large amounts of MG silicon to produce SG silicon.

SUMMARY OF THE INVENTION

The present invention includes methods and apparatus for efficiently purifying MG silicon to produce SG silicon. In one aspect of the present invention, a system for purifying MG silicon includes a container for holding molten silicon, and a heater that can be immersed in the molten silicon. The immersion heater preferably includes an oxygen-hydrogen torch that has a flame surrounded by an inert gas, such as argon, so that the torch provides heat, water vapor, and the inert gas. The inert gas provides space for the flame, and also can be used to carry silica ($SiO_2$) powder to the flame and generate turbulence within the molten silicon. The torch can have a flame surrounded by air. The immersion heater can be a gas lance surrounded by air and/or other combustible gases. In addition to silica powder, the torch or lance can carry water vapor or other reactive powder, liquid, or gas in addition to or instead of the silica powder. The heater can also be used above the melt and the distance above the melt and the flow can be controlled to cause turbulence and stirring.

The container can also include a system for directionally solidifying the melt, e.g., with a cooling system that includes a tank in which the container is held, an inlet for providing a coolant, a plurality of outlets at different vertical positions relative to the container, and a controller for controlling the physical vertical level of the coolant. Alternatively, the melt can be provided into another container for directional solidification, with or without a vacuum.

Accordingly, the method includes prolonging the reaction time for the purification while the silicon is in a molten state by using a torch or lance, and following this prolonged reaction time with directional solidification, with or without evacuation. The torch can be an immersion heater, or the torch can have passages (preferably concentric, although possibly side-by-side) for providing oxygen and hydrogen. Such a torch can be used to direct heat from above the melt with a flame, and without use of plasma or a plasma torch.

A torch is provided over the melt and provides oxygen, hydrogen, and other additives. These additives can include silica powder and CaO, BaO, or $CaF_2$, which are generally known for use in a slag, as shown in U.S. Pat. No. 5,788,945. The use of $CaF_2$ and other fluxes, however, can be undesirable because they can degrade the crucible that holds the silicon.

In another aspect of the present invention, alumina ($Al_2O_3$) is added to lower the melting point of the slag and is stable to still allow for removal of Al from the melt. In addition, other additives such as CaO, BaO are added to make the slag more basic. Basic slags have a higher capacity to capture and return impurities across outer slags. The alumina is used in a sufficient quantity as desired to further lower the melting point of the slag, and to allow the slag to tolerate changes in silica content and remain fully molten. The alumina thus avoids the need to use a flux. Further, the density of the slag can be controlled by adding oxide, for example BaO or CaO, and thus determine whether it is a floating slag or a sinking slag.

In another aspect of the present invention, a method includes steps of submerging an immersible heater, such as a torch, within molten silicon to heat the molten silicon, and preferably also to provide inert gas to permit combustion to generate heat and water vapor and to carry silica powder and to create turbulence to expose more silicon. The torches can be submerged near the bottom of the container, and as processing continues, are raised within the container to assist with directional solidification. A directional solidification step can include raising the torches, and also preferably includes controlling heat extraction from the container.

In another aspect, the invention includes a method of maintaining molten silicon in a liquid state and purifying the molten silicon by stirring, slagging, reaction with moisture, oxidation, evacuation, and reduction. This can be done with or without immersion heating. The torch can be over the melt and have a flame to provide heat. A heater can be provided in or around the crucible for holding the silicon, in which case the torch may not even be needed to provide a flame or heat, but can be used as a lance to introduce oxygen and hydrogen gas in separately controllable amounts.

The present invention provides an effective and efficient mechanism for purifying molten MG silicon to produce SG silicon, in a way that can be done on a large scale as the MG silicon is being produced. This benefit is accomplished without the need for creating a plasma jet. The method includes purifying the silicon with chemical reactions so that products are volatilized or entrapped in slags, enhancing the reaction rate by heating and stirring the melt and by controlling its composition, prolonging the reaction by providing a heat source to keep the silicon in the molten state longer, and controlling the solidification to enhance the purification by the effects of segregation. The torches or gas lances can provide one or more of heat, turbulence, water vapor, silica powder, an additive to make the slag more basic, alumina, and inert gas, all of which are or can be useful and/or necessary in the purification of molten silicon. In the case of torches or gas lances, the oxygen/hydrogen ratio can be controlled to optimize chemical reactions. Other features and advantages will become apparent from the following detailed description, drawings, and claims.

DETAILED DESCRIPTION

Figure 1:
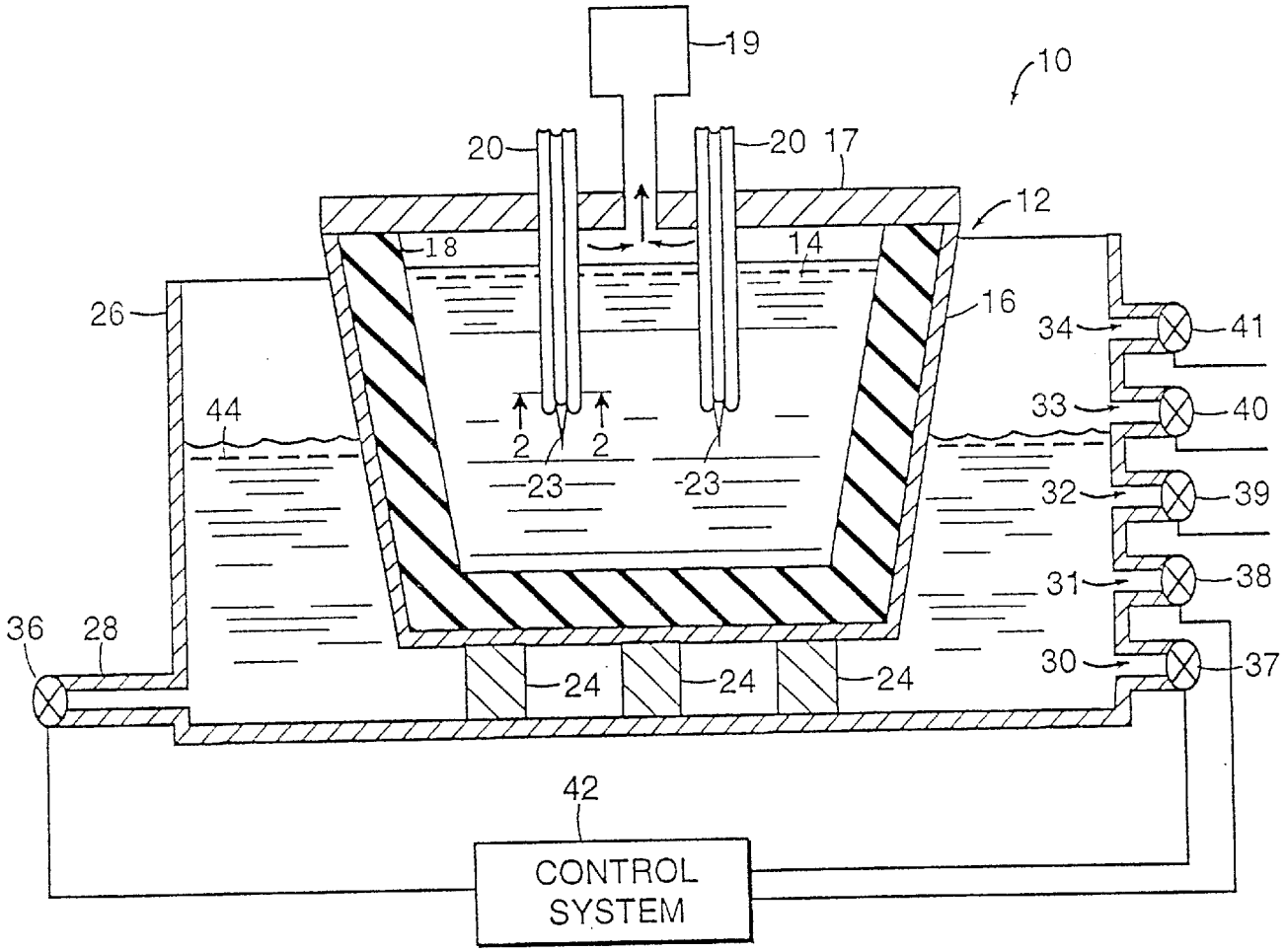
FIG. 1 is a part cross-sectional, part side view of a ladle in which silicon is purified according to the present invention.

Referring to FIG. 1, a system 10 for purifying MG silicon has a ladle 12 for holding molten silicon 14. Ladle 12 has a container 16, an inner lining 18, which is preferably a ceramic, such as high purity silica, and a tightly fitting insulating cover 17 with an exhaust system 19. The ladle can preferably hold about 1 to 2 metric tons at one time, and preferably is provided near an arc furnace where MG silicon is produced, so that the system of the present invention can be used to purify the MG silicon soon after it is manufactured.

Figure 2:
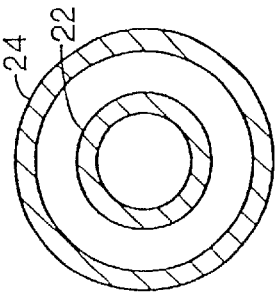
FIG. 2 is a cross-sectional view illustrating a torch used to heat silicon in the ladle.

Extending downwardly into molten silicon 14 from above are a number of immersion heaters, such as oxygen-hydrogen torches 20. Torches 20 provide heat and generate turbulence in the molten silicon. Referring also to FIG. 2, torches 20 have an inner tube 22 with an oxygen-hydrogen flame 23 that is surrounded by argon gas delivered through an outer tube annular 24 that surrounds the flame from inner tube 22 to protect flame 23. Torch 20 is thus similar in principle to torches used for underwater cutting. Outer tube 24 is made of a ceramic material, such as fused silica, alumina mulite, silicon carbide, or silicon nitride. In addition, a fused silica tube can be used as a sheath around crystalline ceramic tubes to prevent contamination. The inert gas can also be a carrier for silica powder, an important known catalyst for purification. The flame is hot, for example, 2000° C., which is significantly higher than the melting point of silicon (1412° C. ). The inert gas can also keep the torch cool, and for this purpose helium or argon could be used. Reactive gases, such as air, can be used instead of helium.

The user can control a number of parameters as desired. The flame rate and the oxygen/hydrogen ratio to the torches 20 can be controlled to control the oxidation or reducing conditions and the turbulence and oxidation conditions in the area of the flame and thus to expose more molten silicon 14 to the flame; the inert flow rate of the inert gas can be controlled to control the area exposed to the flame; the heat in the ladle can be controlled by the size and number of torches, and also by the flame rate; and the amount of silica being introduced is controllable. With proper control, the silicon can thus be maintained in a molten state as long as necessary for purification to occur, typically about one-half day to one day.

The submerged torches are preferably the sole sources of heating for the molten silicon. Alternatively, however, other heating sources can be used in conjunction with the torches, such as the heating coil around the outside of the container as is used with known crucibles.

The torches can be used with a flame to provide heat to the melt from above the melt surface. In this case, the use of argon gas is no longer necessary to provide space for the flame. If the molten silicon is to be heated, a flame using a desired hydrogen-oxygen ratio can be used and the oxidation reduction conditions can be varied by changing that hydrogen-oxygen ratio. Heat can also be added by an external source such as resistance induction, or gas heating, and these heating sources can be controlled to promote directional solidification. If the heat is not necessary from the torches (for example, if the ladle has a heating element), hydrogen or oxygen or even an inert gas like argon can be used for some or all of the following purposes: to provide turbulence, for oxidizing or reducing conditions, as a carrier for various reactant powders, and to provide water vapor.

The torch or lance preferably has a central tube made of silica for carrying oxygen gas, and a concentric tube, also preferably made of silica, for carrying hydrogen gas. The size of the silica tubes can be selected to control the velocities of the gases; in addition, the inner tube may extend all the way to the end of the torch, or it may be recessed somewhat to control the flame and thus provide a wider or narrower flame. The torch thus allows the introduction of oxygen and hydrogen as separately controllable gases. Rather than concentric, two passages for the gases could be side-by-side.

Stirring molten silicon with argon gas promotes a reaction between silicon (Si) and silica ($SiO_2$) to form silicon monoxide (SiO), which itself is gaseous and promotes more stirring. The silica also reacts with oxides and oxihydrides to trap impurities in slags, combines with SiC to encourage reactions that incorporate the carbon into gaseous molecules that can be exhausted, and may help with oxidation of boron. The moisture and oxidizing condition oxidizes the phosphorous, boron, and other impurities to form a slag and thereby to trap these impurities in the slag. The resulting impurity compounds can include, but are not limited to, FeO, $Fe_2O_3$, CaO, $TiO_2$, $Ti_2O_3$, $P_2O_3$, $P_2O_5$, HBO, and $B_2O_3$. Volatile products can also be brought to the surface of the melt and then evacuated with the exhaust system; such volatile products include without limitation HBO, SiO, $BH_3$, volatile phosphorous oxides, and TiO. Reaction with the hydrogen in reducing conditions reduces impurities by forming $PH_3$, $BH_3$, SiH, and $SiH_3$.

Silica powder can be introduced as a reactant for molten silicon to form a slag containing the silica powder and oxides of impurities in molten MG silicon. High silica slags are typically acidic, but most impurities (such as boron and phosphorus) are more readily removed in basic slags. The addition of certain powders such as CaO, or fluxes such as $CaF_2$, make the slag more basic and thus allow it to trap more impurities. Therefore, in addition to adding silica powder as reactant to molten silicon through the carrier gases, it is desirable to add CaO or other basic oxides to control the acidity of the slag.

An additional advantage of additional components in the slag is that they can further reduce the melting point. For an effective slag, it may be desirable for this slag to be in the molten state at the refining temperature and in some cases that the slag have lower melting point than the melting point of silicon. This relationship allows the slag to remove impurities from the meltstock prior to melting.

According to an aspect of the present invention, alumina ($Al_2O_3$) is preferably added to the slag as another component, in addition to CaO, to reduce the melting point, and allow the slag to tolerate increases in silica. Controlling the density with basic or other oxides allows the manufacturer to select a floating slag or a sinking slag. Depending on the refining process being used, a floating slag may insulate the melt from contamination or oxidation, whereas a sinking slag can keep the melt surface open for refining using gases and turbulence of the melt.

An additional advantage of $SiO_2$—CaO—$Al_2O_3$ slags is that they encapsulate molten silicon by forming a molten layer between the solid crucible and the molten MG silicon. Under these conditions, the slag can act as a barrier for contamination of the melt from the crucible as well as minimizing the reactions (for example, grooving) between the crucible and MG silicon.

After the additives have been provided and the molten silicon has been heated for a sufficient period of time, whether through torches, external heaters, or both, the melt is directionally solidified. Directional solidification is known as an effective method for removing impurities that have low segregation coefficients, and thus are incorporated in the last melt to solidify. A number of methods can be used in the ladle itself or in a separate container. In one method and apparatus for controlling such solidification, the container is mounted in a tank with conduits having controllable valves. Container 16 rests on pedestal supports 24 in a tank 26 that has one inlet 28 for bringing in a fluid coolant 44, such as water or oil, and multiple outlets 30–34 at separate vertical heights. Inlet 28 and each outlet 30–34 has a respective valve 36–41 that can be controlled with a control system 42. Control system 42 can include an appropriately programmed general purpose computer or an application-specific integrated circuit (ASIC). The water level in the tank is raised and lowered by selectively closing the outlet valves. (In FIG. 1, valves 36, 40, and 41 are shown open while valves 37–39 are closed.) Flowing water through tank 26 thus causes the silicon melt to solidify directionally from bottom to top over the course of time. Valve 40 is closed when the solid liquid interface is approximately at that position.

To further assist with such directional solidification in the embodiment in which torches are used, the torches 20 are positioned to provide heat in order to promote directional solidification. Torches 20 may be raised above the top of the container while the solid-liquid interface moves upwardly due to the coolant. When this interface nears the top of container 16, torches 20 may be turned off while water continues to flow to cool the solidified silicon ingot rapidly to the ambient temperature. A resulting cooled ingot of silicon is removed from ladle 12, thus causing lining 18 to break up. Crucible 16 therefore has to be relined for a next batch of silicon. Because impurities segregate in the top of the ingot during the directional solidification process, the top layer is removed and the purer silicon below the top layer may be used as melt stock or further refined to EG silicon using a known Siemens process, modified to require fewer distillation steps than are typically used.

To provide the higher grade SG silicon at an early stage where MG silicon is produced, this process can be implemented in an MG silicon manufacturing plant. In this case, an arc furnace in which the MG silicon is first manufactured is provided together with a ladle where the additional purification is performed to effectively produce a two-step process of manufacture and purification. In this case, the silicon can be poured directly from the arc furnace to the ladle for large scale purification, thereby upgrading the quality of the silicon at the source of its manufacturer, and at a greatly reduced cost.

Having described embodiments of the present invention, it should be apparent that modifications can be made without departing from the scope of the invention as described by the appended claims. For example, the molten silicon in the ladle can be poured into a separate mold where directional solidification can be performed. Gas lances can be used instead of torches. Other methods can be used for such directional solidification, including a heat exchanger method in which a heat is extracted from a central portion of the bottom of a crucible, e.g., with a helium-cooled molybdenum heat exchanger. The purification process could be carried out outside the MG silicon plant by remelting the MG silicon; however, the approach of using molten silicon directly from the arc furnace will not require additional energy to remelt the MG silicon. The torches or lances can be introduced from the bottom or side of the container that hold the molten silicon.

What is claimed is:

1. A method for purifying silicon comprising heating molten silicon in a container and providing controllable amounts of oxygen gas and hydrogen gas to the molten silicon.

2. The method of claim 1, further comprising introducing an additional inert gas into the molten silicon.

3. The method of claim 1, wherein the providing is performed with a gas lance submerged in the molten silicon.

4. The method of claim 1, wherein the providing is performed with a gas lance over the molten silicon.

5. The method of claim 1, further comprising introducing water vapor into the molten silicon.

6. The method of claim 1, further comprising introducing silica powder into the molten silicon.

7. The method of claim 6, further comprising introducing inert gas and water vapor into the molten silicon, wherein the purification of the silicon in the molten state is achieved at least in part by chemical reactions with the silica powder and water vapor so that the resultant products are vaporized or trapped in a slag.

8. The method of claim 1, wherein the oxygen and hydrogen are provided by a gas lance without a flame.

9. The method of claim 1, further comprising directionally solidifying the molten silicon in the container.

10. A method for purifying silicon comprising heating molten silicon in a container and using an oxygen-hydrogen torch positioned over the silicon to provide separately controllable amounts of oxygen gas and hydrogen gas.

11. The method of claim 10, further comprising introducing inert gas into the molten silicon with the torch.

12. The method of claim 11, further comprising introducing water vapor into the molten silicon with the torch.

13. The method of claim 10, further comprising introducing a silica powder into the molten silicon.

14. The method of claim 13, further comprising introducing inert gas and water vapor into the molten silicon, wherein the purification of the silicon in the molten state is achieved by chemical reactions with the silica powder and water vapor so that the resultant products are vaporized and trapped in a slag.

15. The method of claim 13, further comprising introducing an additive with the silica, the additive for making a slag in the molten silicon more basic.

16. The method of claim 15, further comprising introducing alumina with the silica and the additive.

17. The method of claim 16, wherein a sufficient amount of alumina is introduced to reduce the melting point of the slag with the silica, additive, and alumina to a point that is lower than the melting point of the silicon.

18. The method of claim 16, wherein a sufficient amount of alumina is introduced to cause the slag with the silica, additive, and alumina to sink in the molten silicon.

19. The method of claim 16, wherein the amount of alumina introduced is such that the slag with the silica, additive, and alumina floats on the molten silicon.

20. The method of claim 10, wherein the torch provides oxygen and hydrogen separately without a flame.

21. The method of claim 10, further comprising directionally solidifying the molten silicon in the container.

22. The method of claims 10, wherein the torch has two passages, one for oxygen gas and one for hydrogen gas.

23. A method for purifying molten silicon, the method comprising:

maintaining silicon in a molten state;

introducing into the molten silicon, a combination including (i) silica, (ii) an additive to make slags move basic, and (iii) alumina.

24. The method of claim 23, wherein the additive to make the slag more basic is selected from the group consisting of CaO, BaO, and $CaF_2$.

25. The method of claim 23, wherein the additive mixture is provided into the molten silicon to control the acidity, melting point, and density of the slag.

26. The method of claim 23, wherein the combination additive mixture is provided into the molten silicon so that the melting point of the slag is less than that of the molten silicon.

27. A method for purifying molten silicon, the method comprising maintaining silicon in a molten state, and introducing into the molten silicon an inert gas with a gas lance without an electron beam gun and without creating a plasma jet.

28. The method of claim 27, wherein the introducing includes introducing hydrogen.

29. The method of claim 27, wherein the introducing includes introducing argon.

30. The method of claim 27, wherein the inert gas is introduced without a flame.

31. The method of claim 27, wherein the gas lance is submerged in the molten silicon.

32. The method of claim 27, wherein the gas lance is over the molten silicon.

33. A method for purifying molten silicon, the method comprising:

maintaining at least one metric ton of silicon in a molten state;

purifying the molten silicon by a combination of stirring, slagging, reaction with moisture, oxidation, evacuation, and reduction; and directionally solidifying the molten silicon.

* * * * *